US009691598B2

(12) United States Patent
Sekimoto et al.

(10) Patent No.: US 9,691,598 B2
(45) Date of Patent: Jun. 27, 2017

(54) IONIZER AND MASS SPECTROMETER INCLUDING FIRST SECTION FOR IONIZING SAMPLE UNDER ATMOSPHERIC PRESSURE WHILE VAPORIZING OR DESORBING THE SAMPLE COMPONENT AND SECOND SECTION FOR GENERATING CORONA DISCHARGE

(71) Applicants: SHIMADZU CORPORATION, Kyoto-shi, Kyoto (JP); Public University Corporation Yokohama City University, Yokohama-shi, Kanagawa (JP)

(72) Inventors: Kanako Sekimoto, Yokohama (JP); Mitsuo Takayama, Tokyo (JP); Daisuke Okumura, Osaka (JP)

(73) Assignees: SHIMADZU CORPORATION, Kyoto (JP); PUBLIC UNIVERSITY CORPORATION YOKOHAMA CITY UNIVERSITY, Yokohama (JP)

( * ) Notice: Subject to any disclaimer, the term of this patent is extended or adjusted under 35 U.S.C. 154(b) by 0 days.

(21) Appl. No.: 14/909,256

(22) PCT Filed: Aug. 2, 2013

(86) PCT No.: PCT/JP2013/071025

§ 371 (c)(1),
(2) Date: Feb. 1, 2016

(87) PCT Pub. No.: WO2015/015641

PCT Pub. Date: Feb. 5, 2015

(65) Prior Publication Data

US 2016/0163527 A1 Jun. 9, 2016

(51) Int. Cl.
*H01J 49/00* (2006.01)
*H01J 49/16* (2006.01)
(Continued)

(52) U.S. Cl.
CPC ..... *H01J 49/167* (2013.01); *H01J 49/142* (2013.01); *H01J 49/145* (2013.01); *H01J 49/168* (2013.01); *H01J 49/26* (2013.01)

(58) Field of Classification Search
CPC .. H01J 49/00; H01J 49/02; H01J 49/10; H01J 49/102; H01J 49/12; H01J 49/14; H01J 49/165; H01J 49/168; H01J 49/18
(Continued)

(56) References Cited

U.S. PATENT DOCUMENTS

2004/0089802 A1 5/2004 Kato
2006/0086908 A1* 4/2006 Fischer ..... H01J 49/06 250/423 R
(Continued)

FOREIGN PATENT DOCUMENTS

JP 2013-37962 A 2/2013

OTHER PUBLICATIONS

Written Opinion for PCT/JP2013/071025 dated Sep. 10, 2013. [PCT/ISA/237].
(Continued)

*Primary Examiner* — Jason McCormack
(74) *Attorney, Agent, or Firm* — Sughrue Mion, PLLC

(57) ABSTRACT

In the ionizer of the present invention, a stream of gas spouted from a nozzle (18) of a DART ionization unit (10) vaporizes and ionizes the components in a sample (25). Gaseous sample-component molecules which have not been ionized by that process are subsequently ionized by a reaction with a reactant ion produced by a corona discharge generated from a needle electrode (20). Such a two-stage ionization of the sample-component molecules improves the ionization efficiency. A needle-electrode support mechanism (21) adjusts the position and/or angle of the needle electrode (20) and thereby controls a potential gradient. Therefore, a
(Continued)

specific sample-derived ion species can be efficiently introduced into an ion introduction tube (31) and be detected with a high level of sensitivity.

14 Claims, 3 Drawing Sheets

(51) Int. Cl.
*H01J 49/14* (2006.01)
*H01J 49/26* (2006.01)

(58) Field of Classification Search
USPC ..... 250/281, 282, 288
See application file for complete search history.

(56) References Cited

U.S. PATENT DOCUMENTS

| | | | | |
|---|---|---|---|---|
| 2007/0138406 | A1 | 6/2007 | Mordehai | |
| 2009/0294660 | A1* | 12/2009 | Whitehouse | H01J 49/045 250/288 |
| 2012/0104248 | A1* | 5/2012 | Hardman | H01J 49/165 250/288 |
| 2013/0082172 | A1* | 4/2013 | Syage | H01J 49/049 250/288 |
| 2013/0299688 | A1* | 11/2013 | Balogh | H01J 49/168 250/282 |

OTHER PUBLICATIONS

Mitsuo Takayama, "Nyuumon Kouza, Shitsuryou Bunseki Souchi No Tame No Ionkahou, Souron (Elementary Guide to Ionization Methods for Mass spectrometry—Introduction to Ionization Methods for Mass Spectrometry)", Bunseki, 2009 issue No. 1, Japan Society for Analytical Chemistry.
Mitsuo Takayama et al., "Gendai Shitsuryou Bunseki Gaku—Kiso Genri Kara Ouyou Kenkyuu Made (Modern Studies on Mass Spectrometry—From Basic Principle to Applied Research)", Kagaku-Dojin, published on Jan. 15, 2013, pp. 63-65.
Min-Zong Huang et al., "Ambient ionization mass spectrometry: A tutorial", Analytica Chemica Acta, Mar. 2011, pp. 1-15, vol. 702.
"12 DIP-it Holder", IonSense Inc., [accessed on Jul. 22, 2013], the Internet <URL: http://www.ionsense.com/12_dip_its>.
"Direct Capillary", IonSense Inc., [accessed on Jul. 22, 2013], the Internet <URL: http://www.ionsense.com/single_pusher>.
"Adjustable Tweezer Base", IonSense Inc., [accessed on Jul. 22, 2013], the Internet <URL: http://www.ionsense.com/tweezers>.
"SVP-45A", IonSense Inc., [accessed on Jul. 22, 2013], the Internet <URL: http://www.ionsense.com/dart_svpa>.
"Infrared Direct Analysis in Real Time Mass Spectrometry", 20 Opotek Inc., [accessed on Jul. 22, 2013], the Internet <URL: http://www.opotek.com/app_notes/MS/IR_DART_MS.pdf>.
Kaveh Jorabchi et al., "Charge assisted laser desorption/ionization mass spectrometry of droplets", J Am Soc Mass Spectrom., 2008, pp. 833-840, vol. 19.
International Search Report of PCT/JP2013/071025 dated Sep. 10, 2013.
Communication dated Jun. 22, 2016 from the European Patent Office in counterpart Application No. 13890838.9.
Communication dated Aug. 29, 2016, from the State Intellectual Property Office of People's Republic of China in counterpart Application No. 201380078641.2.
Communication dated Feb. 22, 2017, from the State Intellectual Property Office of People's Republic of China in counterpart Application No. 201380078641.2.

* cited by examiner

Fig. 4
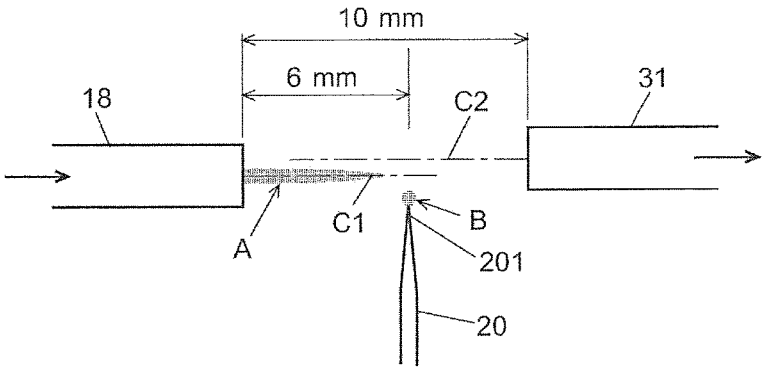
Fig. 5A
Fig. 5B
Fig. 5C
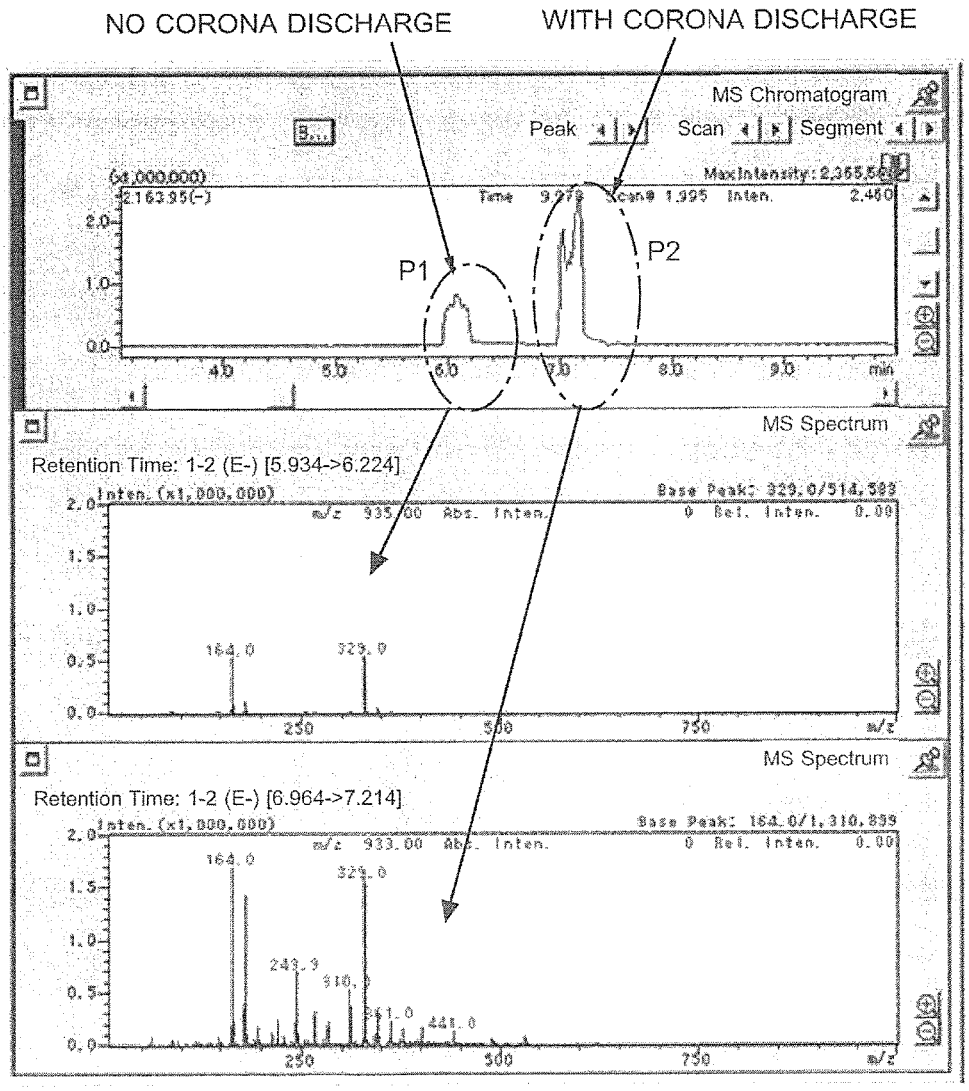

IONIZER AND MASS SPECTROMETER INCLUDING FIRST SECTION FOR IONIZING SAMPLE UNDER ATMOSPHERIC PRESSURE WHILE VAPORIZING OR DESORBING THE SAMPLE COMPONENT AND SECOND SECTION FOR GENERATING CORONA DISCHARGE

CROSS REFERENCE TO RELATED APPLICATIONS

This application is a National Stage of International Application No. PCT/JP2013/071025 filed Aug. 2, 2013, the contents of all of which are incorporated herein by reference in their entirety.

TECHNICAL FIELD

The present invention relates to an ionizer mainly used as an ion source in a mass spectrometer as well as a mass spectrometer using such an ionizer. More specifically, it relates to an ionizer for ionizing a component in a sample under atmospheric pressure as well as a mass spectrometer using such an ionizer.

BACKGROUND ART

Various ionization methods have been known as the techniques for ionizing sample components in a mass spectrometer. Those ionization methods can be roughly divided into the techniques in which the ionization is performed in a vacuum atmosphere and the techniques in which the ionization is performed at substantially atmospheric pressure. The latter kind of techniques are generally called the "atmospheric pressure ionization (API)." The atmospheric pressure ionization is advantageous in that it does not require evacuation of the ionization chamber. Another advantage is that it can easily ionize a sample which is difficult to handle in a vacuum atmosphere, such as a sample in liquid form or a sample abundant in moisture.

Examples of the commonly known atmospheric ionization techniques include the electrospray ionization (ESI) and atmospheric pressure chemical ionization (APCI), which are used in liquid chromatograph mass spectrometers or other apparatuses. In recent years, a number of new atmospheric pressure ionization techniques have been developed or proposed one after another and are attracting people's attention.

Most of these new atmospheric pressure ionization techniques have been developed to meet the demand for an easy and direct analysis of substances present in the surrounding environment ("ambient") around us. Therefore, those ionization techniques are called the "ambient ionization", and the mass spectrometry using those ionization methods is called the "ambient mass spectrometry" (for example, see Non-Patent Literatures 1-3). Although it is difficult to strictly define the ambient ionization, a basic idea common to those techniques is that the measurement can be performed in situ as well as in real time without requiring any special preparation or pre-processing of the sample.

Representative examples of the ambient ionization techniques include the direct analysis in real time (DART) and desorption electrospray ionization (DESI). Additionally, there are various other ionization methods that can be categorized as the ambient ionization, such as the probe electrospray ionization (PESI), electrospray laser desorption ionization (ELDI) and atmospheric solids analysis probe (ASAP), as disclosed in Non-Patent Literatures 2 and 3.

For example, in the DART method, the components in a solid or liquid sample can be ionized by simply inserting the sample in a spray flow of water molecules in an excited state mixed with heated gas. In the DESI method, the components in a sample can be ionized by spraying electrically charged droplets of a solvent onto the sample. Such ionization techniques have various advantages: for example, it is unnecessary to perform a special sample-preparation process for ionization, the structure of the ion source is simple and advantageous for cost reduction, the only substance to be externally supplied for the ionization is the inert gas which is easy to handle, and the sample which has undergone the analysis can be easily handled since there is no liquid (e.g. solvent) sprayed on the sample.

In recent years, the demand for an accurate detection of an extremely trace amount of compound contained in a sample has been increasing with the widening application area of mass spectrometers, the increasingly diverse substances to be analyzed, and other factors. This means that the sensitivity of the ion source also needs to be further improved. Such a demand similarly applies in the case of the aforementioned ion sources employing the atmospheric pressure ionization or those employing the ambient ionization.

For example, previous attempts to improve the sensitivity of the aforementioned DART ion source include optimizing the position of the sample relative to the spray flow (see Non-Patent Literatures 4-6), improving the efficiency of the introduction of the sample-derived ions into the mass spectrometer section (see Non-Patent Literature 7), and improving the vaporization efficiency of the components in the sample using an infrared laser beam (see Non-Patent Literature 8).

CITATION LIST

Patent Literature

Patent Literature 1: JP 2013-37962 A

Non Patent Literature

Non Patent Literature 1: Mitsuo Takayama, "Nyuumon Kouza, Shitsuryou Bunseki Souchi No Tame No Ionkahou, Souron (Elementary Guide to Ionization Methods for Mass spectrometry—Introduction to Ionization Methods for Mass Spectrometry)", *Bunseki,* 2009 issue No. 1, Japan Society for Analytical Chemistry Non Patent Literature 2: Mitsuo Takayama and three other editors, Gendai shitsuryou Bunseki Gaku—Kiso Genri Kara Ouyou Kenkyuu Made (*Modern Studies on Mass Spectrometry—From Basic Principle to Applied Research*), Kagaku-Dojin, published on Jan. 15, 2013

Non Patent Literature 3: Min-Zong Huang and three other authors, "Ambient ionization mass spectrometry: A tutorial", *Analytica Chemica Acta,* 2011, Vol. 702, pp.1-15

Non Patent Literature 4: "12 DIP-it Holder", IonSense Inc., [accessed on Jul. 22, 2013], the Internet Non Patent Literature 5: "Direct Capillary", IonSense Inc., [accessed on Jul. 22, 2013], the Internet Non Patent Literature 6: "Adjustable Tweezer Base", IonSense Inc., [accessed on Jul. 22, 2013], the Internet Non Patent Literature 7: "SVP-45A", IonSense Inc., [accessed on Jul. 22, 2013], the Internet Non Patent Literature 8: "Infrared Direct Analysis in Real Time Mass Spectrometry", Opotek Inc., [accessed on Jul. 22, 2013], the Internet

SUMMARY OF INVENTION

Technical Problem

The previously described conventional techniques for improving the sensitivity in the DART ion source has a limitation in improving the degree of sensitivity. This is due to the fact that most of the conventional sensitivity-improvement techniques are aimed at enhancing the vaporization efficiency of the sample or collection efficiency of the produced ions; none of them is an attempt to improve the ionization efficiency itself of gaseous molecules, i.e. the components vaporized from the sample. In general, including the case of the DART ion source, an ion source which ionizes a sample simultaneously with or immediately after the vaporization of the sample can ionize only a portion of the gaseous molecules; a considerable amount of molecules are discharged without being used for the mass spectrometry. Therefore, to improve the sensitivity of the ion source, it is important to improve the ionization efficiency itself, let alone the vaporization efficiency of the sample.

In particular, in the ambient ionization, normally the sample is directly subjected to an analysis without being separated into components by a liquid chromatograph or other devices, so that a number of foreign substances are ionized together with the target components to be analyzed. Therefore, in the eventually obtained mass spectrum, the peaks derived from the foreign substances are mixed with those derived from the target components, making it difficult to improve the accuracy of the analysis of the target component by simply improving the level of sensitivity. To overcome this problem, it is preferable to selectively improve the level of sensitivity to a specific component. However, such a sensitivity control is difficult to perform with the conventional sensitivity-improvement techniques.

The present invention has been developed in view of such problems. Its objective is to provide an ionizer which is primarily configured to improve the ion generation efficiency itself in the ion source so as to produce a greater amount of sample-derived ions for mass spectrometry and thereby improve the level of sensitivity of the analysis, as well as to provide a mass spectrometer using such an ionizer. Another objective of the present invention is to provide an ionizer capable of improving the generation efficiency of an ion originating from a specific component in a sample, as well as a mass spectrometer using such an ionizer.

Solution To Problem

During the research on the ionization mechanism and related subjects continued over the years, the present inventors have developed a new method of atmospheric pressure corona discharge ionization, as proposed in Patent Literature 1 and other documents, which is based on an idea different from those underlying the older atmospheric pressure corona discharge ionization methods. As far as the mechanism of the ionization of a sample component is concerned, the new atmospheric pressure corona discharge ionization is similar to the common type of atmospheric pressure corona discharge ionization used in the atmospheric pressure photoionization (APPI) or other techniques. Its characteristic exists in that either the shape and position of a needle electrode for corona discharge, or the voltage applied to the needle electrode is devised so that the potential gradient in the area where the ionization occurs as a result of a chemical reaction can be tuned so as to control the reactant ion species for the ionization. The present inventors have conceived the idea of appropriately using this new atmospheric pressure corona discharge ionization method in order to improve the ionization efficiency in an ionizer which employs a conventional atmospheric pressure ionization or ambient ionization. Thus, the present invention has been created.

The ionizer according to the present invention developed for solving the previously described problems is an ionizer for producing a sample-derived ion under atmospheric pressure and for introducing the ion through an ion introduction opening into a subsequent section maintained at a lower gas pressure, the ionizer including:

a) a first ionization section for ionizing a sample component in a solid or liquid sample under atmospheric pressure while vaporizing or desorbing the sample component; and b) a second ionization section located in an area through which gaseous molecules containing the ions produced by the first ionization section travel to the ion introduction opening, the second ionization section including a needle electrode with a tip portion having a curved surface, an ionization condition regulator for adjusting the position and/or angle of the needle electrode relative to the ion introduction opening, and a voltage supplier for applying a high level of voltage to the needle electrode, wherein the second ionization section generates a corona discharge by applying the voltage from the voltage supplier to the needle electrode, the corona discharge producing a reactant ion by ionizing an atmospheric component or solvent molecule, and the reactant ion ionizing a sample molecule by reacting with the sample molecule.

In the ionizer according to the present invention, the first ionization section ionizes a sample component in a solid or liquid sample under atmospheric pressure while vaporizing the sample component. The ionization method used in this first ionization section may be either a method in which the ionization of the component in the sample occurs simultaneously with the vaporization or desorption of the component molecules from the sample, or a method in which the component molecules are vaporized from the sample and the thereby obtained gaseous molecules are subsequently ionized. An ionization method in which sample-derived ions are directly generated from the sample, with neutral molecules simultaneously generated from the sample together with those ions, can also be used.

Although the components in the sample are ionized in the first ionization section, the ion stream or ion cloud formed by collecting the thereby produced ions normally contains a considerable amount of neutral molecules which have not been ionized. During the travel of the stream or cloud of the ions containing the neutral molecules toward the ion introduction opening, the neutral molecules come in contact with the reactant ions produced by the corona discharge generated from the needle electrode in the second ionization section, and turn into ions due to a chemical reaction. That is to say, the components in the sample are initially ionized in the first ionization section, after which the neutral component molecules which have not been ionized in the first stage are also ionized in the second ionization section. Thus, the ionizer according to the present invention performs ionization in each of the two stages, whereby the ionization efficiency is improved.

In particular, in the second ionization section, since the tip surface of the needle electrode has a curved form (e.g. in the form of a hyperboloid of revolution), the electrons emitted from different portions on the tip surface respectively generate different kinds of reactant ions. The thereby produced reactant ions independently move due to the potential gradient in the ionization area between the tip surface of the needle electrode and the member in which the ion introduction opening is formed (the opposite electrode). When the position or angle of the needle electrode relative to the ion introduction opening is changed by the ionization condition regulator, the potential gradient in the ionization area changes, which in turn changes the kind of reactant ion to be introduced into the ion introduction opening. The movement locus of this reactant ion can be considered to be identical to the locus of the sample-derived ion produced by the reaction with the reactant ion. Therefore, by appropriately adjusting the position or angle of the needle electrode relative to the ion introduction opening by the ionization condition regulator, it is possible to create a condition under which the reactant ion species suitable for ionizing the target component among the various components (including foreign substances) contained in the sample is efficiently transferred from the needle electrode to the ion introduction opening, so that the ions derived from the target component by the reaction with the reactant ion are efficiently collected into the vicinity of the ion introduction opening. Thus, the present invention does not only improve the ionization efficiency but can also efficiently produce specific ions derived from the target component in the sample and send them through the ion introduction opening to the subsequent section.

The change in the potential at each portion on the tip surface of the needle electrode, and the consequent change in the potential gradient in the ionization area can also be caused by changing the voltage applied to the needle electrode in the second ionization section. Accordingly, in a preferable configuration of the ionizer according to the present invention, the voltage supplier is capable of adjusting the voltage, and the ionizer adjusts the position and/or angle of the needle electrode relative to the ion introduction opening by the ionization condition regulator as well as the voltage applied from the voltage supplier to the needle electrode, so that a controlled amount of ions derived from a specific component in the sample are allowed to pass through the ion introduction opening.

With this configuration, the ionization efficiency in the second ionization section can be further enhanced, so that the general ionization efficiency including both the first and second ionization sections can be improved.

In the ionizer according to the present invention, the ESI, APCI and various other atmospheric pressure ionization methods can be used for the ionization in the first ionization section, among which an ambient ionization method is particularly preferable. As noted earlier, the ambient ionization method normally does not include the task of preparing or pre-processing the sample, so that the sample contains a comparatively large amount of foreign substances. The ionizer according to the present invention can be tuned to be particularly sensitive to the target component and thereby decrease the relative influence of the foreign substances.

As explained earlier, there are various ionization methods that can be categorized as the ambient ionization, including the already mentioned DART, DESI, PESI, ELDI and ASAP methods. Among those choices, an ionization method in which a component in a sample is ionized by a two-stage process of generating gaseous sample-component molecules from a solid or liquid sample by vaporization or desorption and ionizing the generated sample-component molecules is particularly suitable as the ionization method in the first ionization section.

The reason is because, in general, such an ionization method may possibly allow a considerable proportion of the large amount of gaseous sample-component molecules produced in the first stage to remain non-ionized even after the second-stage ionization. In other words, when the aforementioned type of ionization method is used in the first ionization section, a comparatively large amount of gaseous sample-component molecules are likely to be supplied to the ionization area in the second ionization section, so that the second ionization section can fully produce its ionization effect.

Usually, ionizations can occur by various mechanisms, and a sample containing the same components possibly generates a considerably different set of ion species when a different ionization mechanism is used. Therefore, if the mechanism of the ionization in the first ionization section is significantly different from that of the ionization in the second ionization section, the resulting effect may possibly be a mere increase in the number of kinds of produced ions, with no improvement in the level of sensitivity to each individual ion. Therefore, in order to improve the level of sensitivity to the ions, it is preferable that the mechanism of the ionization in the first ionization section is identical or similar to that of the ionization in the second ionization section.

From this point of view, one of the most preferable ionization methods for the first ionization section is the DART method. In this case, the components in the sample are initially ionized by the DART method, and the gaseous sample-component molecules which remain non-ionized after the first initialization are subsequently ionized by the atmospheric pressure corona discharge ionization in the second ionization section. By this method, the level of sensitivity to each individual ion can be improved while maintaining almost the same quality of the mass spectrum (i.e. the same set of ion species to be detected) as will be obtained if the ionization is performed by using only the DART method.

In the case of using the DART method in the first ionization section, the positioning of the needle electrode relative to the exit end of the nozzle which spouts a heated gas containing excited species (e.g. excited triplet molecular helium) is important. More specifically, the needle electrode needs to be separated from the exit end of the nozzle by a certain distance. This is mainly due to the fact that, when the sample is placed between the exit end of the nozzle and the needle electrode, a space for the Penning ionization of the water molecules in the ambient air by the excited species spouted from the exit end of the nozzle needs to be present between the exit end of the nozzle and the sample. However, if the sample is too distant from the needle electrode, the sample-component molecules which are neutral and insusceptible to the electric field will be dispersed and less likely to reach the area where the reactant ions generated by the corona discharge from the needle electrode are present.

Accordingly, for example, the position of the needle electrode relative to the ion introduction opening should preferably be determined so that a sufficient potential gradient for guiding the reactant ion generated by the corona discharge to the ion introduction opening is formed between the needle electrode and the ion introduction opening (or opposite electrode). On the other hand, the position of the needle electrode relative to the exit end of the nozzle should preferably be determined so that the gas released from the exit end of the nozzle turns into plasma due to the action of the corona discharge from the needle electrode, forming a plasma jet extending from the exit end of the nozzle into the vicinity of the needle electrode. In this case, the sample should preferably be placed in the plasma jet, which is also visible to the human eye. When the relative position of the exit end of the nozzle, needle electrode and sample is determined in this manner, the atmospheric pressure corona discharge ionization can effectively work and a high level of sensitivity can be achieved.

The stream of the heated gas spouted from the nozzle can constitute a factor that prevents the ions from being attracted toward the ion introduction opening along the potential gradient between the needle electrode and the opposite electrode. Therefore, it is preferable to adopt an "off-axis" or "deflected-axis" arrangement in which the central axis of the gas stream spouted from the nozzle does not lie on the same straight line as the central axis of the ion introduction opening.

Advantageous Effects of the Invention

With the ionizer and the mass spectrometer according to the present invention, the ionization efficiency of the gaseous component molecules generated from a sample can be improved, so that a greater amount of ions can be subjected to mass spectrometry and a high level of analysis sensitivity can be achieved. Additionally, in the ionizer and the mass spectrometer according to the present invention, the sample-derived ions can be efficiently collected into the vicinity of the ion introduction opening by the effect of the electric field created between the needle electrode and the ion introduction opening in the second ionization section. Therefore, the efficiency of the introduction of the ions through the ion introduction opening into the subsequent section is also improved, and a greater amount of ions can be effectively supplied for the mass spectrometry.

Furthermore, the ionizer and the mass spectrometer according to the present invention do not only allow the ionization efficiency to be generally improved for various components in a sample; it also allows the ionization efficiency to be selectively improved for a specific ion, e.g. an ion originating from a target component which is attracting the analysis operator's attention. Therefore, even if the sample being analyzed is comparatively abundant in foreign substances, the target component can be easily detected, and consequently, for example, the presence of the target component can be more accurately determined.

BRIEF DESCRIPTION OF DRAWINGS

FIG. 4 shows the arrangement of the components of an ionizer used in an experiment performed to confirm the effect of the present invention.

FIGS. 5A-5C show the result of the experiment performed to confirm the effect of the present invention.

DESCRIPTION OF EMBODIMENTS

One embodiment of the mass spectrometer using an ionizer according to the present invention is hereinafter described with reference to the attached drawings.

Figure 1:
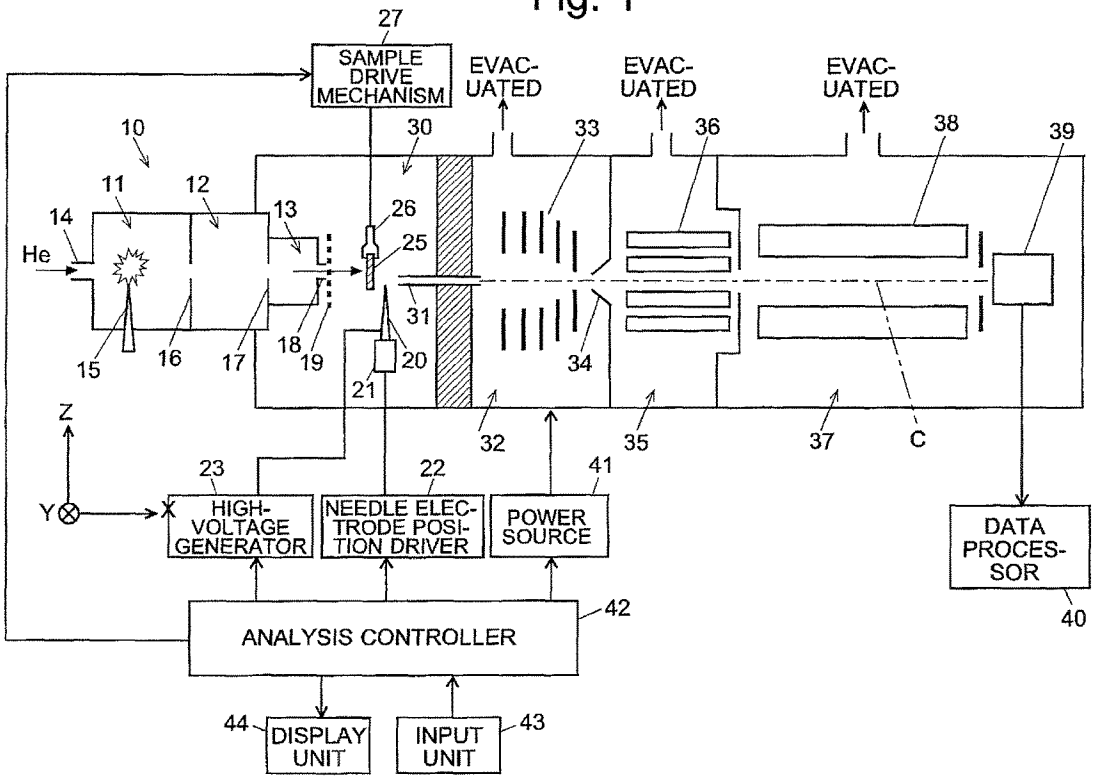
FIG. 1 is a configuration diagram showing the main components of one embodiment of the mass spectrometer using an ionizer according to the present invention.

FIG. 1 is a configuration diagram of the main components of the mass spectrometer of the present embodiment.

The mass spectrometer of the present embodiment has the configuration of a multistage differential pumping system including an ionization chamber 30 maintained at atmospheric pressure and an analysis chamber 37 evacuated to a high degree of vacuum by a high-performance vacuum pump (not shown), between which first and second intermediate vacuum chambers 32 and 35 are provided having the degree of vacuum increased in a stepwise manner. The ionization chamber 30 contains a DART ionization unit 10, a needle electrode 20 for the atmospheric pressure corona discharge ionization, and a sample 25 as the target of the analysis held by a sample holder 26. This ionization chamber 30 communicates with the first intermediate vacuum chamber 32 in the next stage through a thin ion introduction tube 31.

The first and second intermediate vacuum chambers 32 and 35 are separated from each other by a skimmer 34 having a small hole (orifice) at its apex. The first and second intermediate vacuum chambers 32 and 35 respectively contain ion guides 33 and 36 for transporting ions to the subsequent section while converging them. In the present example, the ion guide 33 is composed of a plurality (e.g. four) of virtual rod electrodes arranged around an ion beam axis C, with each virtual rod electrode consisting of a number of plate electrodes arrayed along the ion beam axis C. The other ion guide 36 is composed of a plurality (e.g. eight) of rod electrodes arranged around the ion beam axis C, with each rod electrode extending along the ion beam axis C. It should be noted that the configurations of the ion guides 33 and 36 are not limited to these examples but may be appropriately changed. The analysis chamber 37 contains a quadrupole mass filter 38 for separating ions according to their mass-to-charge ratios m/z and an ion detector 39 for detecting an ion which has passed through the quadrupole mass filter 38. The detection signal produced by the ion detector 39 is sent to a data processor 40.

A power source 41 applies predetermined levels of voltage to the DART ionization unit 10, ion guides 33 and 36, quadrupole mass filter 38 as well as other elements, respectively, under the command of an analysis controller 42. An input unit 43 and display unit 44 to be operated by users (analysis operators) are connected to the analysis controller 42. In general, the analysis controller 42 and data processor 40 are configured on a personal computer provided as hardware resources, with their respective functions realized by running a dedicated control and processing software program previously installed on that computer.

As shown in FIG. 1, the DART ionization unit 10 has three chambers: the discharge chamber 11, reaction chamber 12 and heating chamber 13. A gas introduction tube 14 for introducing helium (which may be a different kind of inert gas, such as neon or nitrogen) is connected to the discharge chamber 11 in the first stage. A needle electrode 15 is provided within the discharge chamber 11. The heating chamber 13 in the last stage is equipped with a heater (not shown). A grid electrode 19 is placed at a nozzle 18 serving as the exit of the heating chamber 13. The DART ionization unit 10 ionizes various components in the sample 25 placed in front of the nozzle 18. Its operation principle is as follows:

Helium is supplied through the gas introduction tube 14 to the discharge chamber 11. After the discharge chamber 11 is filled with helium, a high level of voltage is applied to the needle electrode 15 to cause an electric discharge between the needle electrode 15 and a partition wall 16 which is, for example, at ground potential. This electric discharge causes, for example, a ground state singlet molecular helium gas ($1^1S$) to change into a mixture of helium ions, electrons and excited triplet molecular helium ($2^3S$). This mixture enters the reaction chamber 12 in the next stage. Due to the effect of the electric field created by the voltages respectively applied to the entrance partition wall 16 and exit partition wall 17 of the reaction chamber 12, the helium ions and electrons having electric charges are blocked in the reaction chamber 12; only the excited triplet molecular helium, which is electrically neutral, is sent into the heating chamber 13.

The excited triplet molecular helium which has been heated to a high temperature in the heating chamber 13 is spouted from the nozzle 18 through the grid electrode 19. The inside of the ionization chamber 30 containing the DART ionization unit 10 is maintained at atmospheric pressure, and air is present outside the nozzle 18. The heated excited triplet molecular helium causes the Penning ionization of the water molecules present in this air. The thereby produced water-molecule ions are in an excited state. Additionally, when the gas containing the excited triplet molecular helium is sprayed onto the sample 25, the component molecules in the sample 25 are vaporized due to the high temperature of the gas. When the excited water-molecule ions act on these component molecules produced by the vaporization, a reaction occurs and the component molecules are ionized. Thus, in the DART ionization unit 10, a solid or liquid sample can be ionized directly, i.e. as set in situ.

In the case of commonly used mass spectrometers equipped with the DART ion source, the ions produced from the sample 25 by the previously described process are directly subjected to a mass spectrometry. By contrast, in the mass spectrometer of the present embodiment, an atmospheric pressure corona discharge ion source which includes the needle electrode 20, needle-electrode support mechanism 21, needle-electrode position driver 22, high-voltage generator 23 and other components promotes the ionization of the gaseous component molecules generated from the sample 25 in addition to the DART ionization unit 10. The basic configuration and ionization principle of this atmospheric pressure corona discharge ion source is disclosed in Patent Literature 1.

Figure 2:
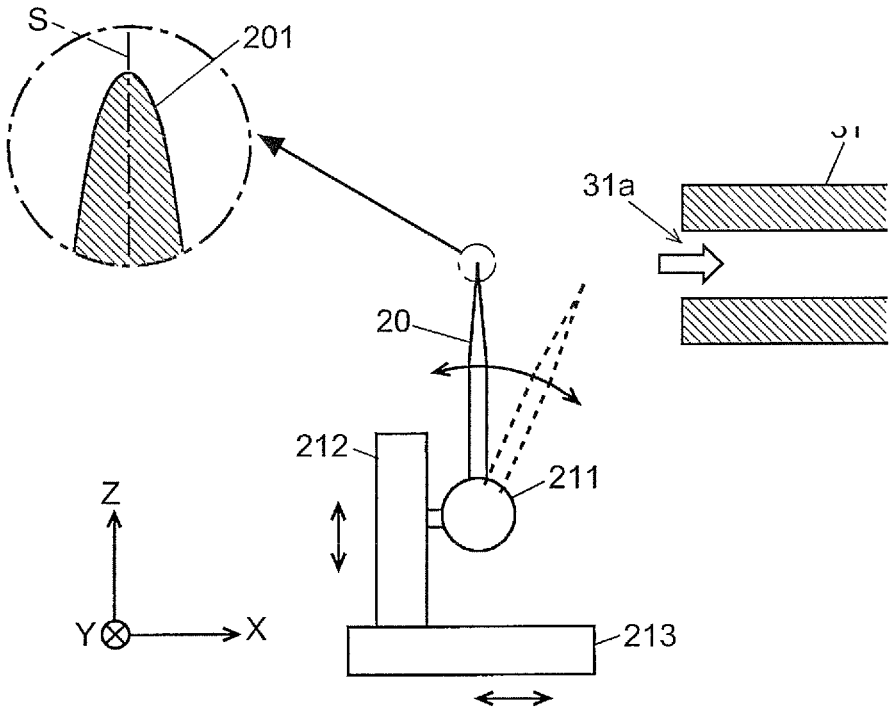
FIG. 2 is a schematic configuration diagram of a needle-electrode support mechanism in FIG. 1.

FIG. 2 is a schematic diagram of the needle electrode 20 and the needle-electrode support mechanism 21 placed between the nozzle 18 of the DART ionization unit 10 and the ion introduction opening 31*a* of the ion introduction tube 31.

The tip portion 20*a* of the needle electrode 20 has a curved surface which is approximated by a hyperboloid, paraboloid or ellipsoid which is rotationally symmetrical with respect to the central axis S, with the radius of curvature of the tip being three micrometers or smaller. The needle-electrode support mechanism 21 supporting this needle electrode 20 includes an X-Y axis drive mechanism 213 capable of moving the needle electrode 20 in the two directions indicated by the X and Y axes in FIG. 2, a Z-axis drive mechanism 212 capable of moving the needle in the Z direction, and a tilting mechanism 211 capable of tilting the needle electrode 20 from the Z axis within a predetermined angular range in any radial direction around the Z axis. For convenience, in the present example, both the direction in which the gas is spouted from the nozzle 18 and the direction in which the ions are drawn into the ion introduction tube 31 are defined as the X axis.

Each of these mechanisms 211-213 includes a motor or another type of actuator and is driven by drive signals fed from the needle-electrode position driver 22. Through these mechanisms, the position and angle of the needle electrode 20 relative to the ion introduction tube 31 can be freely set within the predetermined ranges. However, the position and tilt angle of the needle electrode 20 do not always need to be adjusted through motors or other drive sources; manual adjustment is also possible.

According to a command from the analysis controller 42, the high-voltage generator 23 applies a high level of voltage within a predetermined range of positive and negative voltages to the needle electrode 20. Normally, in the mass spectrometer of the present embodiment, a high level of negative voltage is applied to the needle electrode 20, causing the tip portion 201 of the needle electrode 20 to emit light by a negative corona discharge under atmospheric pressure. The ion introduction tube 31 is either maintained at 0 V (e.g. by being grounded) or at a predetermined direct potential applied from the power source 41. Therefore, when the high level of voltage is applied to the needle electrode 20, an electric field is created between the tip portion 201 of the needle electrode 20 and the entrance wall surface of the ion introduction tube 31 (the circumferential portion of the ion introduction opening 31*a*).

Figure 3A:
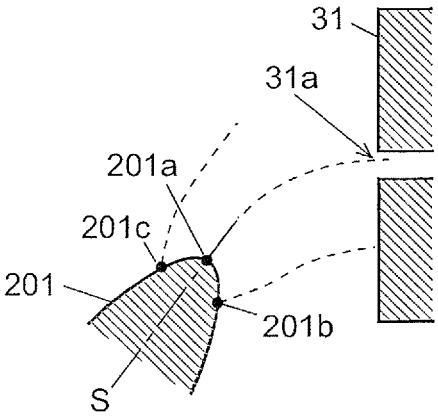
FIGS. 3A and 3B are conceptual diagrams of the lines of electric force in an electric field created between the needle electrode and the ion introduction tube (ion introduction opening).
Figure 3B:
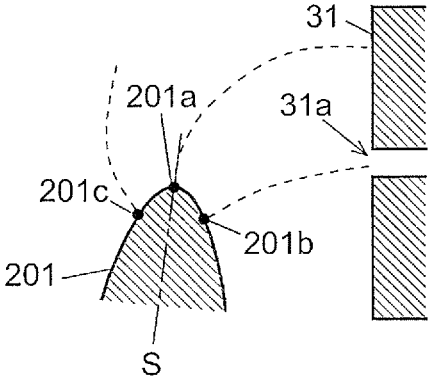

FIGS. 3A and 3B are conceptual diagrams of the lines of electric force in this electric field. In the space between the tip portion 201 of the needle electrode 20 and the entrance wall surface of the ion introduction tube 31, a potential gradient due to the electric field is formed. The presence of this potential gradient can be regarded as the presence of the lines of electric force extending between different positions on the surface of the tip portion 201 of the needle electrode 20 and the entrance wall surface of the ion introduction tube 31, as shown by the broken lines in FIGS. 3A and 3B. These lines of electric force orthogonally intersect with the equipotential surfaces in the electric field. Therefore, as shown in FIGS. 3A and 3B, if the position and/or angle of the needle electrode 20 relative to the entrance wall surface of the ion introduction tube 31 is changed, the line of electric force originating from the same position on the surface of the tip portion 201 reaches a different position on the entrance wall surface of the ion introduction tube 31. In other words, the position on the surface of the tip portion 201 of the needle electrode 20 from which the line of electric force reaching the ion introduction opening 31*a* of the ion introduction tube 31 originates is dependent on the position and/or angle of the needle electrode 20 relative to the entrance wall surface of the ion introduction tube 31. Similarly, if the voltage applied to the needle electrode 20 is changed, the equipotential surfaces in the electric field varies, which causes a change in the position on the surface of the tip portion 201 of the needle electrode 20 from which the line of electric force reaching the ion introduction opening 31*a* of the ion introduction tube 31 originates.

For example, FIGS. 3A and 3B show the lines of electric force originating from negative potential points 201*a*, 201*b* and 201*c* at different positions on the surface of the tip portion 201 of the needle electrode 20. In the state of FIG. 3A, the line of electric force originating from the negative potential point 201*a* lying on the central axis S reaches the ion introduction opening 31*a* of the ion introduction tube 31. On the other hand, in the state of FIG. 3B, the line of electric force originating from the negative potential point 201*b* displaced from the central axis S reaches the ion introduction opening 31*a* of the ion introduction tube 31.

When a negative corona discharge occurs from the needle electrode 20, electrons are emitted from the tip portion 201 of the needle electrode 20. Since air is present around the needle electrode 20, the various components in the air are ionized by the electrons emitted from the needle electrodes 20 and become negative reactant ions. These negative reactant ions move along the potential gradient formed by the aforementioned electric field. More specifically, those ions move from the vicinity of the tip portion 201 of the needle electrode 20 toward the entrance wall surface of the ion introduction tube 31 along the lines of electric force as shown in FIGS. 3A and 3B. As described in Patent Literature 1, electrons emitted from different negative potential points on the tip portion 201 of the needle electrode 20 respectively produce different kinds of reactant ions (e.g. $NOx^-$, $COx^-$, $HO^-$ and so on). For example, in FIGS. 3A and 3B, the kind of reactant ion produced near the negative potential point 201*a* is different from the kind of reactant ion produced near the negative potential point 201*b*. Since those reactant ions move along the lines of electric force, the kind of reactant ion reaching the ion introduction opening 31*a* of the ion introduction tube 31 due to the effect of the electric field varies between the two cases of FIGS. 3A and 3B.

As described earlier, ions are derived from the components in the sample 25 due to the action of the gas spouted from the nozzle 18 of the DART ionization unit 10. Additionally, neutral gaseous component molecules which have not been ionized also pass through the region near the tip portion 201 of the needle electrode 20 together with those ions and travel toward the ion introduction opening 31*a*. During this travel, if a sample-component molecule comes in contact with a reactant ion, a reaction occurs and a sample-component-derived ion is produced. Even if the sample-component molecule is the same, a different kind of ion is produced if a different reactant ion species is involved in the reaction. The sample-component-derived ions produced in this manner move along the lines of electric force similarly to the reactant ions. Therefore, changing the position or tilt angle of the needle electrode 20 causes a change in the kind of sample-component-derived ion reaching the ion introduction opening 31*a* of the ion introduction tube 31 along the line of electric force. Changing the voltage applied to the needle electrode 20 also produces a similar effect.

As described to this point, the ionization of the sample components existing in the form of gaseous molecules which have not been ionized in the DART ionization unit 10 can be promoted by the reactant ions produced by the corona discharge generated by applying a high level of voltage from the high-voltage generator 23 to the needle electrode 20. This process improves the ionization efficiency itself, and not the efficiency of the vaporization or desorption of the component molecules from the sample 25. Consequently, a greater amount of sample-derived ions is produced in the ionization chamber 30, which results in an increase in the amount of ions to be sent through the ion introduction opening 31*a* into the ion introduction tube 31.

In the atmospheric pressure corona discharge ion source in the second stage, among the various kinds of ions derived from the sample components, a specific kind of sample-component-derived ion can be given priority in introduction into the ion introduction opening 31*a* by appropriately adjusting the position and/or angle of the needle electrode 20 relative to the ion introduction opening 31*a* by means of the needle-electrode support mechanism 21 as well as the voltage applied to the needle electrode 20. Therefore, for example, the analysis operator can visually check the mass spectrum in real time and adjust the relative position or angle of the needle electrode 20 and/or the voltage applied to the needle electrode 20 so as to maximize the peak intensity of the target sample-component-derived ion and thereby specifically improve the sensitivity to the target sample-component-derived ion instead of generally increasing the sensitivity to all ions.

Hereinafter described is the result of an experiment performed for verifying the effect of the ionizer installed in the mass spectrometer of the present embodiment. The system used in the experiment consisted of the atmospheric pressure direct analysis ion source "DART-SVP" (manufactured by IonSense Inc., USA) coupled with the quadrupole mass spectrometer "LCMS-2020" (manufactured by Shimadzu Corporation), with the atmospheric pressure corona discharge ion source added. It should be noted that, in this system, the ionization was performed (at atmospheric pressure) outside the ionization chamber originally provided in the mass spectrometer; the produced ions were temporarily introduced through an ion introduction pipe into that ionization chamber and subsequently sent into the ion introduction tube provided as the communication passage from the ionization chamber to the first intermediate vacuum chamber.

FIG. 4 shows the positional relationship of the nozzle of the DART ion source (this nozzle is denoted by numeral 18, since it corresponds to the nozzle 18 of the DART ionization unit 10 in FIG. 1), the needle electrode 20, and the ion introduction pipe (which is denoted by numeral 31 since it corresponds to the ion introduction tube 31 in FIG. 1) in the system used in the experiment.

The distance between the end of the nozzle 18 and that of the ion introduction tube 31 is 10 mm. The central axis C1 of the nozzle 18 and the central axis C2 of the ion introduction tube 31 are parallel to and displaced from each other by approximately 1-2 mm. The needle electrode 21 is placed so that its tip portion 201 is 6 mm away from the end of the nozzle 18. The tip portion 201 is displaced from the central axis C1 of the nozzle 18 by approximately 1 mm in the opposite direction from the central axis C2.

In such an arrangement, when a negative corona discharge is generated by applying a high predetermined level of negative voltage (e.g. within a range from −1.5 to −5 kV) to the needle electrode 21, a region "B" emitting pale blue light is formed at the tip portion 201 of the needle electrode 20. Simultaneously, a region "A" with an elongated glow of violet light extending from the end of the nozzle 18 (gas exit end) along the central axis C1 is also formed. This glow in region "A" is considered to be a plasma jet formed by the substances in the gas. By placing a sample in this region "A", the components in the sample can be detected with a high level of sensitivity.

FIGS. 5A-5C show an experimental result obtained when the sample was placed at the optimum position in the previously described arrangement. FIG. 5A is a graph showing the temporal change of the signal intensity of the sample-component-derived ions. The first peak P1 corresponds to the state where no voltage was applied to the needle voltage 20 (and hence no corona discharge), while the second peak P2 corresponds to the state where the corona discharge was generated by applying the voltage to the needle electrode 20. FIG. 5B is the mass spectrum corresponding to the peak P1 in FIG. 5A, while FIG. 5C is the mass spectrum corresponding to the peak P2 in FIG. 5A. That is to say, FIG. 5B is the mass spectrum obtained when only the DART ionization was performed, while FIG. 5C is the mass spectrum obtained when the DART ionization was combined with the atmospheric pressure corona discharge ionization.

A comparison between FIGS. 5B and 5C demonstrates that the sample-component-derived ions with m/z 164.0 and m/z 329.0, which were detected with comparatively high levels of sensitivity with only the DART ionization, have much higher signal intensities in FIG. 5C, reaching three or more times as high as the previous levels. This experimental result confirms that, with the ionizer adopted in the mass spectrometer of the present embodiment, a dramatic improvement in the level of sensitivity can be achieved than with the conventional ionizers.

In the previous embodiment, the DART method is used in the first stage of the ionization. It is possible to use various other ionization methods mentioned earlier other than the DART method. If it is necessary to perform a measurement of a solid or liquid sample in situ without pre-processing the sample, the various ionization methods called the ambient ionization are naturally the preferable choices, among which an ionization method which produces a large amount of gaseous sample-component molecules by vaporization or desorption in the ionization process is especially preferable. In order to improve the sensitivity while preventing the mass spectrum from being too complex, it is preferable to use an ionization method whose ionization mechanism is identical or similar to that of the atmospheric pressure corona discharge ionization. A specific example of the preferable methods other than the previously described ASAP method is the charge assisted laser desorption/ionization (CALDI). A detailed description of the CALDI is available in a literature by Jorabchi K et al., "Charge assisted laser desorption/ionization mass spectrometry of droplets", *J Am Soc Mass Spectrom.,* 2008, Vol. 19, pp. 833-840, or other documents.

It should be noted that the previous embodiment is a mere example of the present invention, and any change, modification or addition appropriately made within the spirit of the present invention in any other respect than the ionization method used in the first stage will naturally fall within the scope of claims of this application.

REFERENCE SIGNS LIST

10 . . . DART Ionization Unit
11 . . . Discharge Chamber
12 . . . Reaction Chamber
13 . . . Heating Chamber
14 . . . Gas Introduction Tube
15 . . . Needle Electrode
16 . . . Entrance Partition Wall
17 . . . Exit Partition Wall
18 . . . Nozzle
19 . . . Grid Electrode
20 . . . Needle Electrode
20*a* . . . Tip Portion
21 . . . Needle-Electrode Support Mechanism
22 . . . Needle-Electrode Position Driver
23 . . . High-Voltage Generator
25 . . . Sample
26 . . . Sample Holder
30 . . . Ionization Chamber
31 . . . Ion Introduction Tube
31*a* . . . Ion Introduction Opening
32, 35 . . . Intermediate Vacuum Chamber
33, 36 . . . Ion Guide
34 . . . Skimmer
38 . . . Quadrupole Mass Filter
39 . . . Ion Detector
40 . . . Data Processor
41 . . . Power Source
42 . . . Analysis Controller
43 . . . Input Unit
44 . . . Display Unit

The invention claimed is:

1. An ionizer for producing a sample-derived ion under atmospheric pressure and for introducing the ion through an ion introduction opening into a subsequent section maintained at a lower gas pressure, the ionizer comprising:

a) a first ionization section for ionizing a sample component in a solid or liquid sample under atmospheric pressure while vaporizing or desorbing the sample component; and b) a second ionization section located in an area through which gaseous molecules containing ions produced by the first ionization section travel to the ion introduction opening, the second ionization section including a needle electrode with a tip portion having a curved surface, the ion introduction opening being formed within another electrode, an ionization condition regulator for adjusting a position and/or an angle of the needle electrode relative to the other electrode within which the ion introduction opening is formed, and a voltage supplier for applying a voltage to the needle electrode, wherein the second ionization section generates a corona discharge by applying the voltage from the voltage supplier to the needle electrode irrespective of the position and/or the angle of the needle electrode relative to the ion introduction opening, the corona discharge between the needle electrode and the other electrode producing a reactant ion by ionizing an atmospheric component or solvent molecule, and the reactant ion ionizing a sample molecule by reacting with the sample molecule.

2. The ionizer according to claim 1, wherein:

the voltage supplier is capable of adjusting the voltage, and the ionizer adjusts the position and/or the angle of the needle electrode relative to the ion introduction opening by the ionization condition regulator as well as the voltage applied from the voltage supplier to the needle electrode, so that a controlled amount of ions derived from a specific component in the sample are allowed to pass through the ion introduction opening.

3. The ionizer according to claim 1, wherein:

the first ionization section performs an ionization by an ambient ionization method.

4. The ionizer according to claim 3, wherein:

the first ionization section performs an ionization by a real-time direct ionization method.

5. The ionizer according to claim 4, wherein:

the position of the needle electrode relative to the ion introduction opening is determined so that a sufficient potential gradient for guiding the reactant ion generated by the corona discharge to the ion introduction opening is formed between the needle electrode and the ion introduction opening.

6. The ionizer according to claim 4, wherein:

the first ionization section includes a nozzle for spouting gas containing an excited species for the ionization by the real time direct ionization method, and the position of the needle electrode relative to an exit end of the nozzle is determined so that the gas released from the exit end of the nozzle turns into plasma due to an action of the corona discharge from the needle electrode, forming a plasma jet extending from the exit end of the nozzle into a vicinity of the needle electrode.

7. The ionizer according to claim 6, wherein:

a central axis of a gas stream spouted from the nozzle and a central axis of the ion introduction opening are arranged in an off-axis or deflected-axis form.

8. A mass spectrometer comprising, as an ion source, an ionizer for producing a sample-derived ion under atmospheric pressure and for introducing the ion through an ion introduction opening into a subsequent section maintained at a lower gas pressure, the ionizer including:

a) a first ionization section for ionizing a sample component in a solid or liquid sample under atmospheric pressure while vaporizing or desorbing the sample component; and b) a second ionization section located in an area through which gaseous molecules containing ions produced by the first ionization section travel to the ion introduction opening, the second ionization section including a needle electrode with a tip portion having a curved surface, the ion introduction opening being formed within another electrode, an ionization condition regulator for adjusting a position and/or an angle of the needle electrode relative to the ion introduction opening, and a voltage supplier for applying a voltage to the needle electrode, wherein the second ionization section generates a corona discharge between the needle electrode and the other electrode by applying the voltage from the voltage supplier to the needle electrode irrespective of the position and/or the angle of the needle electrode relative to the other electrode within which the ion introduction opening is formed, the corona discharge producing a reactant ion by ionizing an atmospheric component or solvent molecule, and the reactant ion ionizing a sample molecule by reacting with the sample molecule.

9. The mass spectrometer according to claim 8, wherein:

the voltage supplier is capable of adjusting the voltage, and the ionizer adjusts the position and/or the angle of the needle electrode relative to the ion introduction opening by the ionization condition regulator as well as the voltage applied from the voltage supplier to the needle electrode, so that a controlled amount of ions derived from a specific component in the sample are allowed to pass through the ion introduction opening.

10. The mass spectrometer according to claim 8, wherein:

the first ionization section performs an ionization by an ambient ionization method.

11. The mass spectrometer according to claim 10, wherein:

the first ionization section performs an ionization by a real-time direct ionization method.

12. The mass spectrometer according to claim 11, wherein:

the position of the needle electrode relative to the ion introduction opening is determined so that a sufficient potential gradient for guiding the reactant ion generated by the corona discharge to the ion introduction opening is formed between the needle electrode and the ion introduction opening.

13. The mass spectrometer according to claim 11, wherein:

the first ionization section includes a nozzle for spouting gas containing an excited species for the ionization by the real time direct ionization method, and the position of the needle electrode relative to an exit end of the nozzle is determined so that the gas released from the exit end of the nozzle turns into plasma due to an action of the corona discharge from the needle electrode, forming a plasma jet extending from the exit end of the nozzle into a vicinity of the needle electrode.

14. The mass spectrometer according to claim 13, wherein:

a central axis of a gas stream spouted from the nozzle and a central axis of the ion introduction opening are arranged in an off-axis or deflected-axis form.

* * * * *